United States Patent [19]

Stanley et al.

[11] Patent Number: 4,756,004

[45] Date of Patent: Jul. 5, 1988

[54] SELF BAKING ELECTRODE WITH PRESSURE ADVANCEMENT

[76] Inventors: Earl K. Stanley, 2790 Lynn Dr., Frederick, Md. 21701; James M. Black, Route #1, Box 170A, Beverly, Ohio 45715

[21] Appl. No.: 15,152

[22] Filed: Feb. 13, 1987

[51] Int. Cl.[4] ..... H05B 7/09

[52] U.S. Cl. ..... 373/89; 204/286; 204/294

[58] Field of Search ..... 373/89, 97; 204/286, 204/294

[56] References Cited

U.S. PATENT DOCUMENTS 4,122,294 10/1978 Frolov ..... 373/89

4,575,856 3/1986 Persson ..... 373/89

*Primary Examiner*—Roy N. Envall, Jr.

*Attorney, Agent, or Firm*—Berman, Aisenberg & Platt

[57] ABSTRACT

A self-baking electrode includes a pressure chamber for receiving electrode paste under pressure. A centrally located conductor supplies electrical current to the paste, and the paste is baked by passage of the electrical current to form an electrode. The electrode is supported by a support band and is advanced past the support band by supplying paste under pressure to the pressure chamber. The pressure chamber is heated to maintain the paste in a softened state.

12 Claims, 1 Drawing Sheet

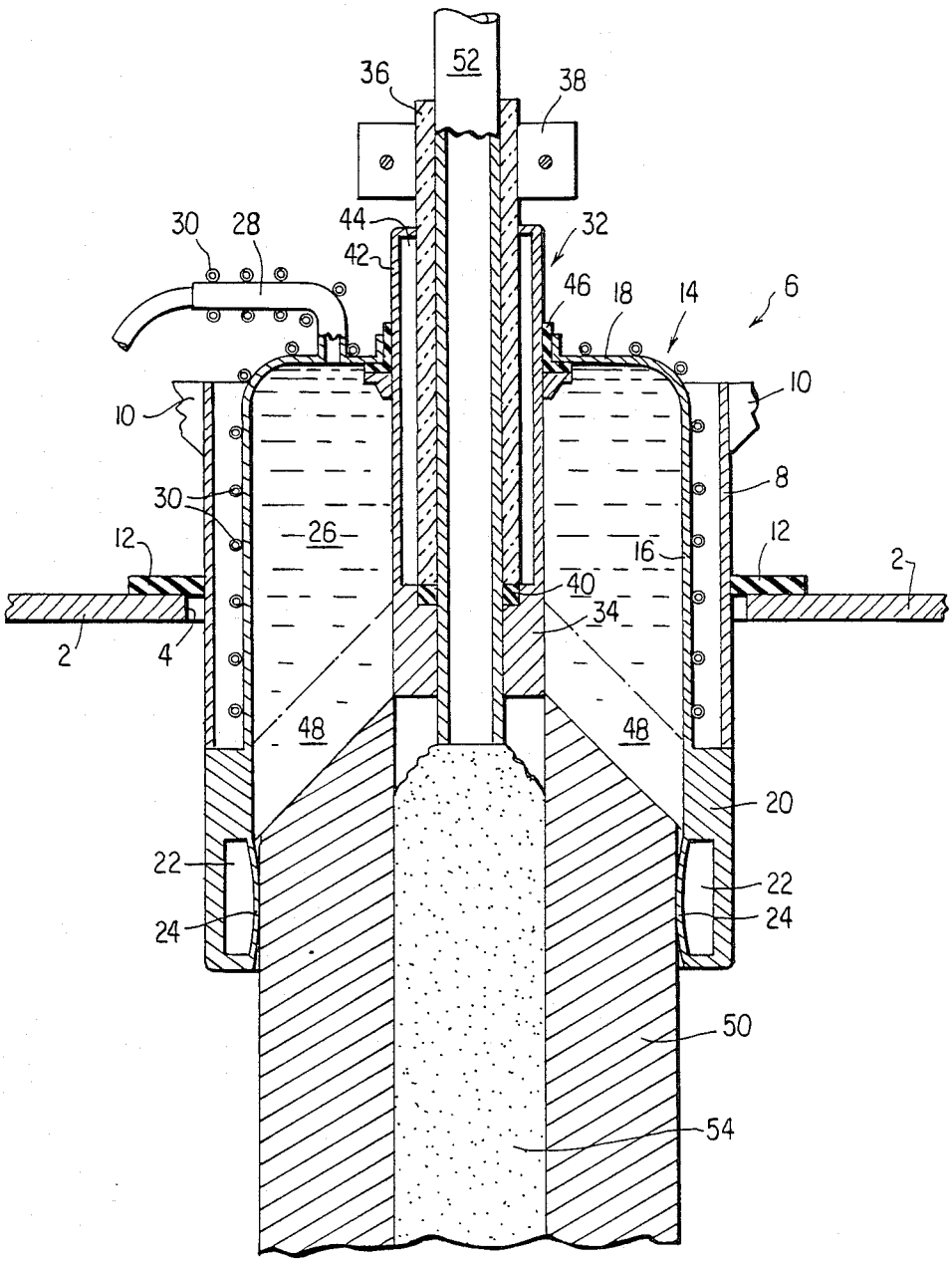
52
36
38
30
28
44
42
32
46
18
14
6
10
10
8
30
26
12
16
12
2
40
34
2
4
48
48
20
22
22
24
24
50
54

SELF BAKING ELECTRODE WITH PRESSURE ADVANCEMENT

TECHNICAL FIELD

This invention relates to the art of self-baking electrodes.

BACKGROUND OF THE INVENTION

In the refining of metal, such as silicon metal, an electrode is brought into contact with ore to provide electric current to heat the ore to bring about a refining reaction. During this process, the electrode is consumed, and it is necessary to advance the electrode to maintain its contact with the ore.

A known type of electrode for this purpose is a self-baking electrode. These electrodes utilize an electrode paste which is subjected to elevated temperatures (preferably approximately 400° C.) to "bake" the paste into a somewhat rigid electrode. The electrical resistivity of the baked electrode paste is lower than that of the unbaked paste so that the baked electrode conducts sufficient current to heat the ore without significant energy loss.

Known self-baking electrodes are shown in U.S. Pat. Nos. 1,442,031 (Soderberg); 1,640,735 (Soderberg); 3,524,004 (Van Nostran et al.); and 4,527,329 (Bruff et al.).

Other known self-baking electrodes utilize an elongate casing having support structure, such as radially-directed fins, a cable having transverse bars thereon, or an elongate cylinder of graphite for engaging the electrode paste and the baked electrode to provide support. During the refining operation, the entire structure is allowed to advance downwardly into the furnace. Support elements are located remote from the furnace and generally engage a casing which is advanced into the furnace and is consumed along with the electrode. The electrode paste is baked by passage of electrical current through it, and the current is provided by shoes in contact with the electrode at a location closer to the furnace than that of the support elements.

SUMMARY OF THE INVENTION

In accordance with the invention, a unique self-baking electrode is provided wherein pressure of the electrode paste causes advancement of the baked electrode. In a preferred embodiment, a chamber is provided for receiving electrode paste through a conduit. A central conductor provides electrical current which flows through the unbaked paste toward the outer surface of the electrode because of a phenomenon known as "skin effect." The passage of current through the paste heats the paste to a baking temperature to produce a baked electrode which is engaged by a band to support it. The baked electrode is forced past the band by the pressure of the electrode paste.

In a preferred embodiment, the paste is supplied to the conduit by a pump, and the pressure applied to the paste by the pump is adjusted to move the baked electrode at a continuous rate to virtually eliminate sticking between the baked electrode and the support band or between the electrode paste and the central conductor.

Because the central conductor causes an opening in the central portion of the baked electrode, a chute is provided to supply material, such as coke, to prevent escape of furnace gases. The conductor is also preferably cooled because of the high temperatures created by the high electric current.

The electrode paste softens at a temperature of 95° to 130° C., and the pressure chamber is preferably provided with a heat exchanger to maintain the paste in a softened or fluid state.

It is an object of this invention to provide a self-baking electrode wherein a baked electrode is caused to advance by the pressure of electrode paste.

Another object of this invention is to provide self-baking electrode wherein electrode paste is provided to a pressure chamber having a centrally-located conductor for supplying electrical current to the paste.

BRIEF DESCRIPTION OF THE DRAWINGS

The FIGURE shows a longitudinal cross-section of a preferred embodiment of a self-baking electrode in accordance with the invention.

DETAILED DESCRIPTION OF THE INVENTION

The FIGURE is a longitudinal cross-section of a preferred embodiment of a self-baking electrode in accordance with the invention. A furnace hood 2 has an opening 4 therein which receives a pressure vessel 6 therein. Pressure vessel 6 includes a cylindrical wall 8 having hydraulic ram supports 10 at an upper edge for engaging hydraulic rams (not shown) for supporting pressure vessel 6. A seal 12 extends between the edge of opening 4 and the outer surface of cylindrical wall 8 to prevent the escape of furnace gases.

Pressure vessel 6 includes pressure chamber 14 which is generally cylindrical and includes downwardly extending side walls 16 and top 18. Pressure chamber 14 is open at its bottom and is connected to a support band 20 which forms the lower part of pressure vessel 6. Support band 20 includes a bore 22 and a flexible support 24 which forms an interior wall of the support band.

Pressure chamber 14 is filled with self-baking electrode paste 26, and the paste is supplied through a conduit 28 which is connected to a pump (not shown) capable of supplying paste 26 at a rate adequate to advance a baked portion of the electrode, which will be described below, at a desired rate and at a pressure sufficient to provide the pre-determined rate of advancement of the baked portion. For example, a high-pressure positive displacement pump is contemplated.

To maintain paste 26 in a softened, partially liquid condition, conduit 28 and pressure chamber 14 are heated by contact with coils 30 which may, for example, be supplied with steam. It is desirable to maintain the paste in conduit 28 and pressure chamber 14 at a temperature in the range of 95° to 130° C., and this may be accomplished by passing steam through coil 30. It should be noted, however, that when the electrode is used, a lower part of pressure chamber 14 may become heated to a temperature larger than that which is desired, whereupon the fluid passing though coils 30 will serve to equalize the temperatures throughout pressure chamber 14 by cooling those areas which have been heated to a temperature greater than that of the medium in coil 30.

Top 18 of pressure chamber 14 includes an opening for receiving a water cooled power mandrel 32. Power mandrel 32 includes a conductor 34 connected to cylindrical bus 36 which is in turn connected to a source of electrical power at clamp 38. Conductor 34 may be of a material different from that of bus 36, and electrical connection is made at weld 40. Because the high current flow required during use of the invention may cause the power mandrel to overheat, an outer casing 42 is spaced from bus 36 to form a water-cooling passage 44 through which water is circulated to maintain power mandrel 32 at a predetermined temperature.

Power mandrel 32 is preferably separated from pressure chamber 14 by electrical insulation 46.

During operation of the electrode, electricity is supplied to conductor 34, and that electricity passes through paste 26 and into the charge of ore (not shown) to be refned. Because of the phenomenon known as "skin effect", the major part of the electricity from conductor 34 passes radially outwardly and is carried into the ore by a relatively small outer portion of the electrode. Accordingly, as the electricity passes outwardly through paste 26, it will heat the paste to form a baking zone 48. This baking zone is a region wherein the temperature of paste 26 is allowed to increase to approximately 400° C. As the baking proceeds, a baked electrode 50 is produced, and this electrode is somewhat rigid and has a markedly reduced electrical resistance.

Baked electrode 50 is engaged and supported by flexible surface 24.

Because centrally-located conductor 34 creates a central hole in baked electrode 50, a chute 52 is provided to allow introduction of a filler 54, such as coke.

It will be appreciated that the inward curvature of flexible surface 24 is exaggerated in the FIGURE. In practice, the inward flexing will be quite small. Bore 22 may be filled with molten lead to apply a variable pressure resulting in a variable amount of flexing of surface 24 to permit a variable force to be applied to the outer surface of baked electrode 50. This permits the force supporting electrode 50 to be adjusted to allow the electrode to be advanced at a desired rate. Other structures for support band 20 are possible. For example, surface 24 may be rigid, and small inward projections may be used to grip baked electrode 50.

In operation, an initial baked electrode portion 50 is produced by known techniques, and pressure chamber 14 is filled with paste 26. Electrical current is then applied to conductor 34 by bus 36, and this electrical current passes through paste 26 and forms baking zone 48. As baking progresses, the pressure of paste 26 is increased to cause baked electrode 50 to slowly, and preferably continuously, be forced past support band 20 and into the furnace. As baked electrode 50 moves downwardly into the furnace, additional paste is pumped into pressure chamber 14 through conduit 28. The volume of paste which must be pumped into chamber 14 is substantially identical to the volume of the baked electrode advanced into the furnace.

It will be appreciated that the rate of advancement can, through experience, be matched very closely to the rate of consumption of baked electrode 50 in the furnace to permit continuous movement of baked electrode 50 and continuous supply of paste 26. This is quite advantageous because the constant movement of baked electrode 50, baking zone 48, and paste 26 prevents these components from sticking to the pressure vessel or to the support band.

Support band 20 may be made of a wear-resistant metal, such as cast steel, and pressure chamber 14 may be made of stainless steel. It is contemplated that the pressure chamber be designed to withstand a pressure of 300 lb. per square inch. Other materials will be apparent to those of skilled in the art.

What is claimed is:

1. A self baking electrode comprising conductor means for extending into a central region of unbaked electrode paste and for supplying electric current to said unbaked electrode paste to at least partially bake said paste, support means for engaging at least partially baked electrode paste and for controllably supporting said at least partially baked electrode paste, means for containing unbaked paste, and means for applying pressure to said unbaked paste to move said paste past said conductor means and said support means.

2. An electrode according to claim 1 wherein said means for applying pressure comprises means for supplying unbaked paste to said means for containing unbaked paste.

3. An electrode according to claim 2 wherein said means for containing unbaked paste comprises an enclosure extending upwardly from said support means for enclosing said unbaked paste.

4. An electrode according to claim 3 wherein said means for applying pressure comprises a conduit which is in fluid communication with said enclosure.

5. An electrode according to claim 4 further comprising temperature control means for maintaining said unbaked paste fluid.

6. An electrode according to claim 5 wherein temperature control means comprises a heat exchanger attached to said enclosure means.

7. An electrode according to claim 1 wherein said support means comprises means extending radially inwardly by an adjustable amount.

8. An electrode according to claim 7 wherein said means extending radially inwardly by an adjustable amount comprises a diaphragm which forms one wall of an annular bore.

9. An electrode according to claim 1 wherein said conductor means comprises a cylindrical element located on a longitudinal axis of said means for containing unbaked paste, and further comprising chute means for supplying filler to a cavity in said at least partially baked paste.

10. A method for refining ore comprising providing the electrode of claim 1, causing electrical contact between said at least partially baked paste and said ore, passing electrical current through said at least partially baked paste and said ore, and applying sufficient pressure to said unbaked paste to cause said at least partially baked paste to move into said ore at a predetermined rate.

11. A self-baking electrode comprising a pressure housing and conductor means, said pressure housing forming a gas-tight enclosure for containing unbaked electrode paste, said housing having an opening at one end thereof for receiving a baked electrode portion and a conduit for supplying unbaked paste to said enclosure, said opening having means for controllably holding said baked electrode portion, and said conductor means supplying electric current to said unbaked electrode paste.

12. A self-baking electrode according to claim 11 wherein said conductor means is located within said housing to supply said electric current to a central location of said electrode paste and wherein said electrode provides substantially all of the electric current directed to said electrode.

* * * * *